United States Patent [19]

Jones

[11] 4,247,003

[45] Jan. 27, 1981

[54] PRODUCT DISPLAY CARD

[75] Inventor: Robert C. Jones, Hastings, Nebr.

[73] Assignee: Dutton-Lainson Company, Hastings, Nebr.

[21] Appl. No.: 37,367

[22] Filed: May 9, 1979

[51] Int. Cl.[3] ..... B65D 73/00; G09F 1/00; B65D 85/00

[52] U.S. Cl. ..... 206/486; 40/124.1; 206/45.14; 248/152

[58] Field of Search ..... 206/486, 45.14; 248/152; 40/124.1, 310, 311, 307, 306

[56] References Cited

U.S. PATENT DOCUMENTS

| | | | |
|---|---|---|---|
| 1,403,197 | 1/1922 | Rieck | 222/567 |
| 3,050,183 | 8/1962 | Mueller, Jr. | 40/124.1 |
| 3,355,830 | 12/1967 | Hoffman | 40/124.1 |

FOREIGN PATENT DOCUMENTS

| | | | |
|---|---|---|---|
| 474498 | 11/1937 | United Kingdom | 248/152 |

*Primary Examiner*—William T. Dixson, Jr.
*Attorney, Agent, or Firm*—Allegretti, Newitt, Witcoff & McAndrews

[57] ABSTRACT

An improved product display card includes a planar back member and two die-cut connected product support members projecting from the back member. Openings in the support members receive the threaded neck of a product container. A screw top threaded onto the neck retains the container on the support members of the display card.

4 Claims, 6 Drawing Figures

Fig. 4
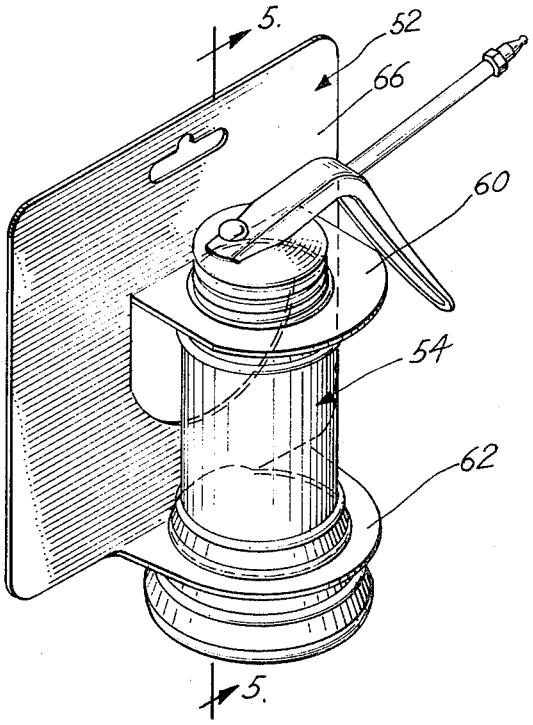
Fig. 5
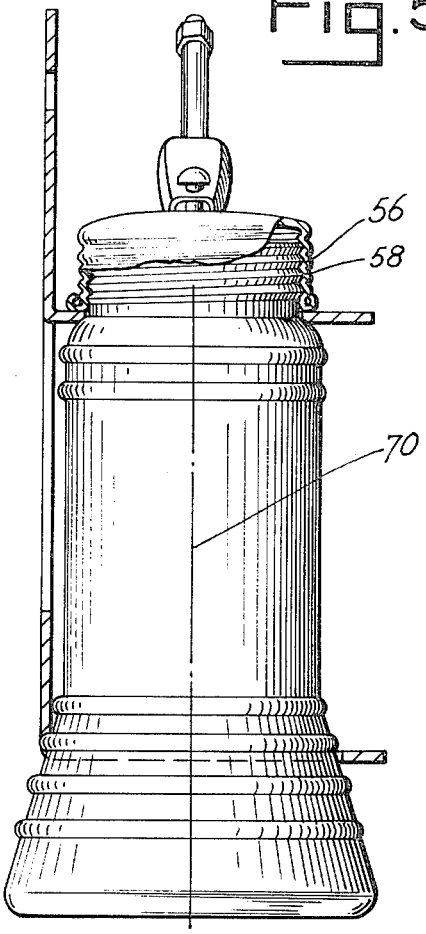
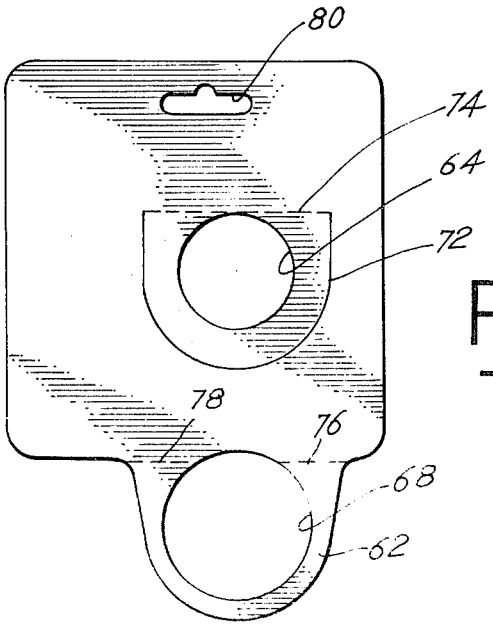
Fig. 6

PRODUCT DISPLAY CARD

BACKGROUND OF THE INVENTION

This invention relates to an improved product display card and more particularly to a product display card which is adapted to receive containers having a threaded top that may be attached onto a neck.

Product display cards used for merchandising of hardware products and the like may also constitute a means to store and support such products on a display rack. In the past, products have been stored in boxes or similar containers. Another method of storage is known as the "blister" pack. In a blister pack, a plastic film retains a hardware item on a display card.

While such prior art display and storage arrangement are quite suitable for their intended purpose, an improved and simplified display arrangement is desired, particularly for products wherein a screw top is affixed over a threaded neck of a container. For example, an oil can or a similar container which has a screw top is desirably positioned on a display card which can be easily displayed at a stand. Preferably access is provided to the product for testing of the product without necessarily removing it from the display card. By elimination of wrapping material for the product and the card, a cost savings is realized.

SUMMARY OF THE INVENTION

Briefly, the present invention comprises an improved product display card which is formed from a sheet of display card material such as a cardboard sheet. An arrangement of cuts and openings is defined in the display card so that at least two integral product support members fold transversely outward from the display card back and cooperate with a product of the type having a threaded neck and cooperative screw top. Various embodiments of the invention fabricated from a single sheet of display card material are disclosed.

It is thus an object of the invention to provide an improved product display card which does away with the need for additional wrapping, staples or other means for attaching a product to a display card.

A further object of the present invention is to provide an improved product display card which may be printed and cut from a sheet of flat cardboard or the like and subsequently folded in an appropriate configuration for retention of a product on the display card.

Another object of the present invention is to provide a product display card which may be attached or hung from a display rack.

It is a further object of the present invention to provide a product display card which is easy to manufacture, economical, rugged and which provides a means for display of a product and also permits product access for testing of the product while on the display card.

These and other objects, advantages and features of the invention will be set forth in the detailed description which follows.

BRIEF DESCRIPTION OF THE DRAWING

In the detailed description which follows, reference will be made to the drawing comprised of the following figures:

FIG. 4 is a perspective view of a second embodiment of the display card of the present invention;

FIG. 5 is a cross sectional view of the display card of FIG. 4 taken substantially along the line 5—5; and FIG. 6 is a plan view of a sheet of display card material cut to form a display card of FIG. 4.

DESCRIPTION OF THE PREFERRED EMBODIMENTS

Figure 1:
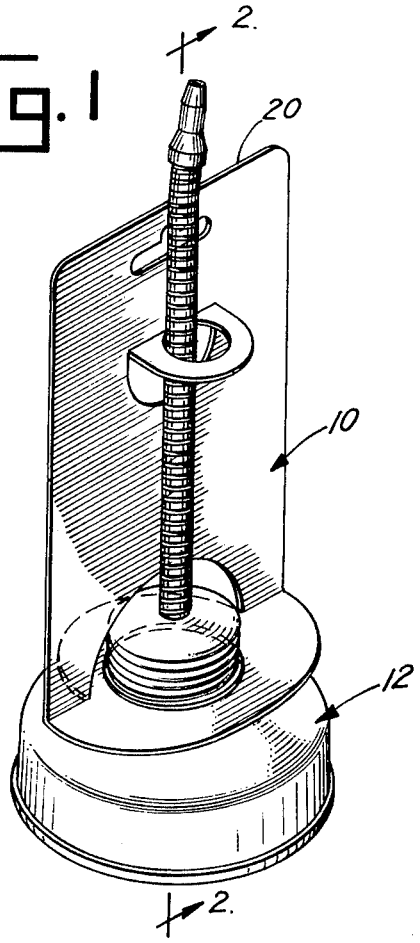
FIG. 1 is a perspective view of a first embodiment of the display card of the invention wherein a product has been positioned in the display card.

Referring to FIG. 1, a product display card 10 incorporating the present invention is shown in combination with a product, namely, a flexible spout oil can 12. Can 12 includes a screw top 14 with a flexible projecting stem 16. The top 14 is threaded for cooperation with threaded neck 16 of an oil container 18.

Figure 3:
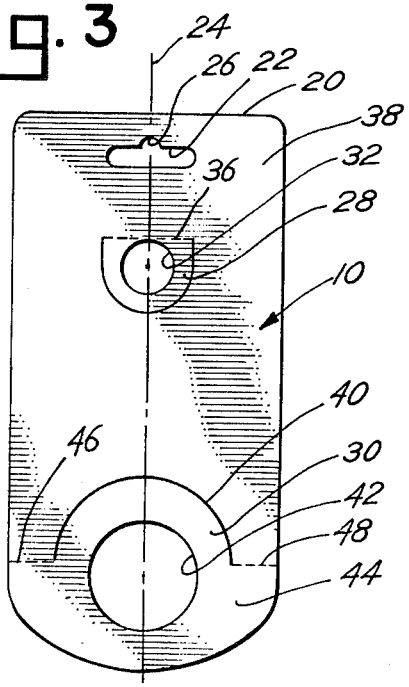
FIG. 3 is a plan view of a planar sheet of display card material cut to form the display card of FIG. 1.

The display card 10 is fabricated from a single planar sheet of display card material as illustrated by FIG. 3. The display card 10 includes a top edge 20 with a product support slot 22 die cut through the card 10 adjacent the edge 20 substantially symmetrically about a center line, longitudinal axis 24 of the card 10. The slot 22 includes a center detent 26 for cooperation with a pin or rod of a display rack. The slot 22 extends longitudinally in opposite directions from the detent 26 to permit cooperation with various types and sizes of hangers.

The card 10 also includes first and second integral product support members 28 and 30. Cut 30 in card 10 defines the member 28. The first product support member 28 includes a die cut circular opening or passage 32. The member 28 and opening 32 are symmetrical with respect to axis 24. The member 28 is folded along one edge outwardly along an imaginary line 36 transverse to axis 24 so that the support member 28 is also transverse to the back 38 of the display card 10.

Figure 2:
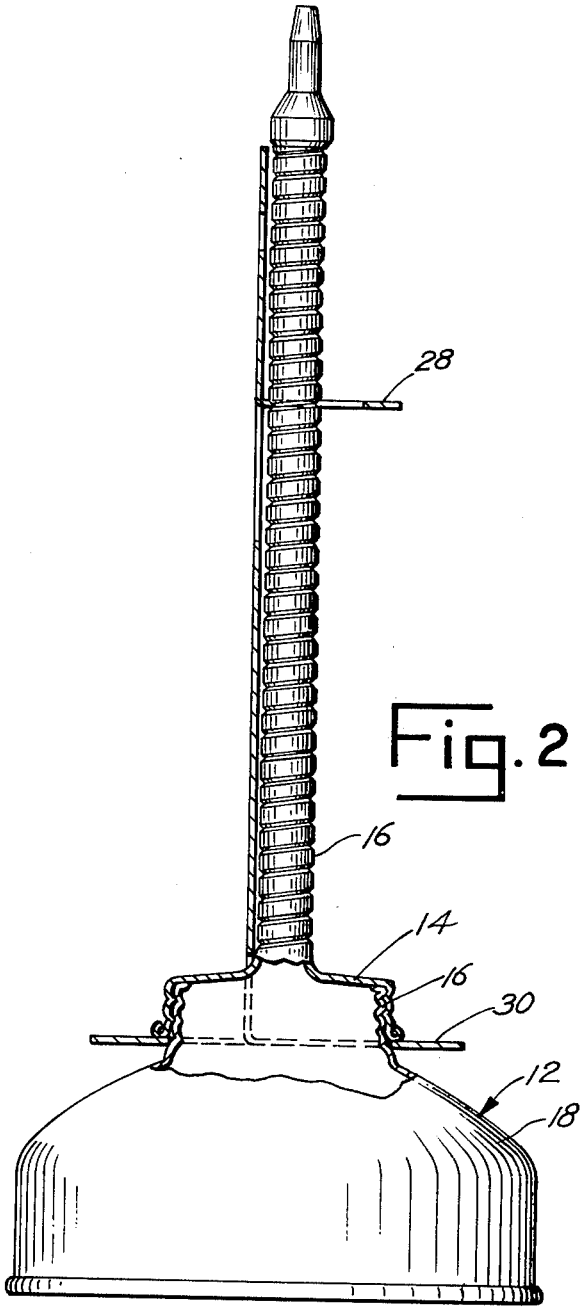
FIG. 2 is a cross sectional view of the improved display card of the invention taken substantially along the line 2—2 in FIG. 1.

In similar fashion, the second product support member 30 is formed by making an arcuate die cut 40 in card 10. In the embodiment of FIGS. 1–3 the cut 40 defines an arc which is opposed to the cut 30 defining tab member 34.

An opening 42 is defined through the member 30. The member 30 thus bends along imaginary lines 46 and 48 to thereby define the transverse product support member 30. The product support member 30 and product support member 28 are folded with respect to the back member 38 so that they are generally transverse to the back member 38 and parallel to one another as shown in FIG. 2. The opening 42 in member 30 is sufficiently large enough to receive the neck 16. However, the top 14 has a greater radial dimension than the radius of opening 42. This is an important feature of the invention since it permits retention of the oil can on the display card 10.

When the support members 28 and 30 are arranged as shown in FIG. 2, the openings 32 and 42 have a substantially common axis 13 which coincides with an axis of the container or can 12. Axis 13 is parallel to the back member 38. Note that with the display card of the present invention it is possible to position the oil can 12 on a display rack via slot 22, and retain it on the rack. No special wrapping or the like is required. The card supports the entire product. The product may even be tested while it remains supported by the card.

FIGS. 4–6 illustrate a second embodiment of the invention. Referring to those figures, a card 52 supports another type of oil can 54 having a screw top 56 mounted on a threaded neck 58. Transverse product support members 60 and 62 cooperate with the can 54. Specifically, support member 60 includes an opening 64 through which the neck 58 projects when the support member 60 is folded transverse to back member 60 of card 52. The opening 64 is sufficiently large to receive the neck 58. However, the opening 62 is smaller than the top 56. Thereby screwing the top 56 on the neck 58 will retain the can 54 on the display card.

The lower support member 62 also includes an opening 68 through which the can 54 is inserted before insertion of neck 58 through opening 62. The midpoint of the openings 64 and 68 are generally coaxial and lie along a line which is parallel to the back member 66. The midpoints thus define an axis 70 which is spaced from the back member 66, a distance approximately equal to the radius of the openings 64 and 68.

The support members 60 and 62 are formed by cuts and folds in the card 52. Thus an arcuate cut 72 and a fold 74 define support member 60. The support member 62 is likewise cut from card 52 and defined by folds 76 and 78. The display card of FIGS. 4–6 also has a slot 80 of the type described with respect to the embodiment of FIGS. 1–3.

In each embodiment, two support members 28, 30, 60 and 62 are used. These members 28, 30, 60 and 62 are preferably spaced at least one-half of the axial dimension of the product so as to improve stability of the display. Also it is possible to use more than two support members for cooperation with a product.

The product display card of the present invention has the various advantages discussed above, including elimination of any special wrapping material to retain the product on the card. Staples, tape and other product retention means are avoided. Since there are at least two transverse support arms, such as arms 60 and 62, for cooperation with the product, the product is retained as desired in fixed position on the display card. The product can also be removed from the display card with ease or it may be tested while remaining on the display card. Thus, while there has been set forth a preferred embodiment of the invention, it is to be understood that the invention is to be limited only by the following claims and their equivalents.

What is claimed is:

1. An improved product display card for displaying a product of the type having a removable top of greater diameter than a threaded neck that receives the top, said card comprising:

a planar back member having at least two integral, generally parallel product support members cut from the back member and projecting horizontally and generally transversely from the back member from a fold line;

one of said support members having an opening sized for receipt of the neck only through the opening and providing means whereby a top may be affixed to the neck to thereby retain the product on the card, said opening having a midpoint, the midpoint of said opening being transversely spaced from the planar back member;

the other product support member being spaced from the one member and also having an opening for receipt of the product and for permitting the product to project therethrough, said other support member opening also having a midpoint which is substantially axially aligned with the midpoint of said one support member, each of the openings being entirely within a transverse support member and generally conforming to a transverse section of the product shape, said product being removable from the display card only subsequent to removal of the top from the neck of the product; and a hanger member incorporated integrally onto the back member along a top edge thereof.

2. The improved product display card of claim 1 wherein said midpoint is spaced from said card a distance slightly greater than the maximum radial dimension of the product.

3. The improved display card of claim 1 wherein said support members are spaced from each other a distance which is greater than one-half of the product length being displayed on the display card.

4. The improved display card of claim 1 wherein the midpoints of the openings are coaxial and said axis is parallel to the planar member.

* * * * *